US005310184A

United States Patent [19]

Grist

[11] Patent Number: 5,310,184

[45] Date of Patent: May 10, 1994

[54] TRANSPARENT PRIZE PRESENTING GAME

[76] Inventor: Elizabeth A. Grist, 9660 Dundawan Rd., Baltimore, Md. 21236

[21] Appl. No.: 976,261

[22] Filed: Nov. 13, 1992

[51] Int. Cl.[5] ..... A63F 9/06

[52] U.S. Cl. ..... 273/153 R; 273/156

[58] Field of Search ..... 273/153 R, 156, 109, 273/110, 113, 115, 440, 441, 429, 430; 70/289; 446/8, 10; 434/332

[56] References Cited

U.S. PATENT DOCUMENTS

| | | | |
|---|---|---|---|
| 282,978 | 8/1883 | Goudie . | |
| 296,689 | 4/1884 | Hart et al. . | |
| 615,381 | 12/1898 | Brockett . | |
| 677,895 | 7/1901 | Skinner . | |
| 744,886 | 11/1903 | Wade . | |
| 746,612 | 12/1903 | Wade | 446/8 |
| 2,007,831 | 7/1935 | Neitz et al. | 232/4 |
| 2,398,011 | 4/1946 | Kaplan | 273/161 |
| 2,563,007 | 8/1951 | Laufer | 273/109 |
| 3,218,754 | 11/1965 | Hunter . | |
| 3,650,379 | 3/1972 | La Montagne | 206/1.5 |
| 3,979,840 | 9/1976 | Waggoner et al. | 273/153 R |
| 4,066,265 | 1/1978 | Bredlau | 273/153 R |
| 4,136,542 | 1/1979 | Robison | 273/153 R |
| 5,066,014 | 11/1991 | Dobson | 273/110 |
| 5,149,093 | 9/1992 | Schilling et al. | 273/121 A |
| 5,213,325 | 5/1993 | Malavazos et al. | 273/109 |

FOREIGN PATENT DOCUMENTS

| | | | |
|---|---|---|---|
| 9114486 | 10/1991 | World Int. Prop. O. | 273/153 R |

*Primary Examiner*—Vincent Millin
*Assistant Examiner*—Steven B. Wong
*Attorney, Agent, or Firm*—Leonard Bloom

[57] ABSTRACT

A transparent prize presenting game having a puzzle or challenge to be solved or completed. The game is capable of presenting a paper prize, such as paper money, stock certificates and the like, thereby motivating a player to solve and complete the puzzle or challenge. The game has a transparent container. The paper prize is removably disposed in the container, so that access thereto without successfully completing the puzzle or challenge is prevented. The puzzle or challenge is disposed in the container. Arrangements are provided that permit access to the paper prize only upon the successful completion of the puzzle or challenge. In this fashion, the user is provided with the motivation of the paper prize to successfully complete the puzzle or challenge.

20 Claims, 11 Drawing Sheets

TRANSPARENT PRIZE PRESENTING GAME

FIELD OF THE INVENTION

The present invention relates to games which present prizes for the successful completion thereof and, in particular, to transparent games in which a paper prize, such as paper money, stock certificates or the like is disposed therein so as to be viewed by the user for providing motivation to successfully complete the game and which, when successfully completed, automatically presents the user with access to the paper prize.

BACKGROUND OF THE INVENTION

Games involving a puzzle or challenge which must be solved or otherwise successfully completed are well-known. Unfortunately, such puzzles and challenges provide the users thereof with little motivation to encourage the completion thereof other than the mere satisfaction that such successful completion provides. Thus, they are of relatively little use for, i.e., learning games.

It is also well-known to provide banks that are also toys or incorporate toys therein to encourage individuals, such as children to save money by playing with them. Examples of such banks are disclosed in U.S. Pat. No. 296,689 issued to Hart et al; U.S. Pat. No. 677,895 issued to Skinner; U.S. Pat. No. 2,007,831 issued to Neitz et al; U.S. Pat. No. 2,398,011 issued to Kaplan; U.S. Pat. No. 3,218,754 issued to Hunter; and U.S. Pat. No. 3,650,379 issued to La Montagne. However, in such banks, the motivation provided to play with the bank is to save money that is disposed therein. Unfortunately, such banks do not provide motivation for individuals who are not interested in saving money.

I am also aware of toy banks which are in the form of boxes or containers which have a window or a series of mirrors, so that the money therein can be readily viewed. In this fashion, it is hoped that individuals, and in particular children, will be visually encouraged to use the bank to save money. An example of such a bank is disclosed in U.S. Pat. No. 282,978 issued to Goudie. Unfortunately, as with the banks noted above, these banks do not provide motivation for individuals who are not interested in saving money.

The provision of transparent containers for packaging purposes for various articles is also well-known. Such containers, commonly referred to as "blister packs" are often used to store household electric batteries, as well as other items.

There are also banks which require the user thereof to perform an activity to open the bank in order to retrieve the money that is contained therein. Such banks are disclosed in U.S. Pat. No. 615,381 issued to Brockett and U.S. Pat. No. 744,886 issued to Wade. Unfortunately, neither of these banks permit the targeted user thereof to visually view the money therein. Thus, the motivation for such a user to employ the bank is seriously diminished.

Finally, I am aware of one toy, disclosed in U.S. Pat. No. 2,563,608 issued to Laufer, which permits a potential user to visually view a coin and which presents the user with the coin upon the successful guiding of the coin through a maze. Unfortunately, this toy is limited for use only with coins and is not suitable for, nor capable of, distributing other types of prizes, such as paper money, stock certificates, etc.

While being useful for their purposes, none of the banks, toys or games of which I am aware present the users thereof with a challenge or puzzle that is capable of distributing paper prizes, such as paper money, stock certificates, etc., which challenge or puzzle distributes such a prize only upon completion or solving of the puzzle or challenge and which game permits visual viewing of the paper prize for encouraging users to employ them for their purposes. Thus, these devices are limited in their use as a motivational tool.

To the best of my knowledge, no one has provided a game involving a puzzle or challenge, the solving of which could be used as an educational tool (or learning game) and which provides sufficient motivation, i.e. by means of presenting a reward, such as paper money, stock certificates or the like to encourage one to use and successfully complete the game. Finally, to my knowledge, no one has provided a game which is completely transparent to better view the reward and/or is fabricated from molded plastic, so as to reduce the costs of the fabrication thereof.

Accordingly, it can be seen that there remains a need for providing a game involving a puzzle or a challenge, which game automatically presents a paper prize, such as paper money, stock certificates and the like upon the successful completion of the puzzle or challenge for motivating a user thereof to complete the puzzle or challenge.

SUMMARY OF THE INVENTION

It is the primary object of the present invention to provide a game involving a puzzle or a challenge, which game provides a sufficient motivation to encourage the user to complete the puzzle or challenge.

It is another primary object of the present invention to provide such a game which provides motivation for the successful completion thereof by presenting a paper prize, such as paper money, stock certificates and the like to encourage one to use the game and successfully complete the puzzle or challenge presented thereby.

A further primary object is to provide such a game, wherein the paper prize may be loaded therein at any time and wherein access to the paper prize is thereafter restricted to the successful completion of the puzzle or challenge.

A still further objective is to provide such a game, wherein the paper prize may be visually viewed by one whom it is desired to attract to attempt to successfully complete the puzzle or challenge presented thereby.

A yet further object is to provide such a game which is an educational game that may be utilized as a learning tool.

Another yet further object is to provide such a game that is simple to use and inexpensive to fabricate.

In accordance with the teachings of the present invention, a transparent prize presenting game which has a puzzle or challenge to be solved or completed is disclosed. The game is capable of presentation of a paper prize such as paper money, stock certificates and the like for motivating one to successfully complete the puzzle or challenge. The game has a transparent container. A paper prize, such as paper money, stock certificates or the like, is removably disposed in the container, so that access thereto without completing the puzzle or challenge is prevented. A puzzle or a challenge is disposed in the container to be solved and completed for providing access to the paper prize. Finally, means is provided for providing access to the paper prize only upon the successful completion of the puzzle or challenge, whereby the user thereof is provided with the motivation of the paper prize to successfully complete the puzzle or the challenge presented by the game.

In one aspect of the present invention, the transparent prize presenting game is disclosed which has a maze including a goal and a ball which requires one to guide the ball through the maze and place the ball in the goal to successfully complete the challenge. The game is capable of presentation of a paper prize such a money and the like upon placement of the ball in the goal for motivating one to successfully complete the maze by placement of the ball in the goal. The game includes a transparent substantially hollow container. The maze and the goal thereof are formed from plastic ridges that are located within the container. A paper prize, such as paper money, stock certificates or the like, is removably disposed in the container, so that access thereto without completing the maze and placing the ball in the goal is prevented, and further so that access to the paper prize upon successful completion of the maze by placement of the ball in the goal is provided. Means is supplied for providing access to the paper prize only upon the successful completion of the maze by the placement of the ball in the goal. The means for providing access to the paper prize includes a slit formed in the container and a slidable drawer for receiving the paper prize therein. The drawer is disposed in the container for radial sliding movement through the slit between a first open position and a second closed position. In the first open position, the drawer extends at least partially outwardly from the container, so that the paper prize is accessible to the user. In the second closed position, the drawer is disposed within the container, so that the paper prize is inaccessible to the user. The means further includes a first resilient biasing means and a second resilient biasing means. The first resilient biasing means is provided for constantly resiliently biasing the drawer outwardly through the slit and into the first open position thereof. The second resilient biasing means is provided for constantly resiliently biasing the drawer out of alignment with the slit. In this fashion, the drawer may be pushed inwardly overcoming the first biasing means until the drawer is disposed in the second closed position thereof within the container. In the second closed position, the drawer is then biased out of alignment with the slit by the second biasing means for loading the drawer. With the puzzle or challenge successfully completed, the user may overcome the second biasing means and move the drawer back into alignment with the slit.

In another aspect of the present invention, the transparent prize presenting game has a challenge comprised of a series of questions which have responses that are required to be given thereto by the user to successfully complete the challenge. The game is capable of the presentation of a paper prize such as paper money, stock certificates and the like, upon the user thereon supplying the correct responses to the questions. In this fashion, the game provides motivation for a user to successfully respond to the questions and complete the challenge. The game includes a transparent, substantially hollow container. A paper prize, such as paper money, stock certificates or the like, is removably disposed in the container, so that access to the paper prize without successfully supplying the correct responses to the questions and completing the challenge is prevented, and further so that access to the paper prize by successfully supplying the correct responses to the questions is provided. Means is supplied for providing access to the paper prize only upon successfully supplying the correct responses to the questions. In this fashion, the user thereof is provided with the motivation of the paper prize to successfully complete the challenge provided by the game. The means includes a series of response switches which are carried by the container and which switches must be properly positioned by the user in response to the questions. The means further includes a hinged hatch door that is formed in the container, so as to permit access to a portion of the interior of the container where the paper prize is disposed. In this fashion, the paper prize may be disposed in and removed from the container. A latch and bolt is formed between the door and the container, so as to selectively permit the door to be opened for selectively providing access to the paper prize, and further so as to selectively lock the door shut, thereby denying access to the paper prize. The bolt is moveable between a first open position and a second closed position. In the first open position, the bolt is removed from the latch to selectively unlock the door so it is open, thereby permitting access to the paper prize. In the second closed position, the bolt is disposed in the latch to selectively lock the door shut, thereby denying access to the paper prize. Finally, means is provided for moving the bolt between the first open and second closed positions thereof. This means is associated with the successful supplying of correct responses to the questions and completion of the challenge.

These and further objects and advantages of the present invention will become readily apparent from a reading of the following description taken in conjunction with the enclosed drawings.

BRIEF DESCRIPTION OF THE DRAWINGS

FIG. 6 illustrates a user moving and tilting the game to guide the ball through the maze and into the goal, so as to successfully complete the puzzle presented thereby.

FIG. 7 illustrates the user having successfully completed the puzzle by guiding the ball into the goal of the maze.

FIG. 8 illustrates the user who has successfully completed the puzzle pushing downwardly thereon to overcome the second biasing means and align the drawer with the slit and the aligned drawer being moved into the first open position thereof, wherein the drawer extends at least partially outwardly from the container and access to the paper prize is provided.

FIG. 9 illustrates the successful user removing the paper prize from the puzzle.

FIG. 10 illustrates the paper prize being loaded into the drawer which is in the first open position thereof.

FIG. 11 illustrates the drawer, with the paper prize therein, being pushed back (loaded) into the container.

FIG. 15 illustrates the insertion (loading) of a question (or quiz) card into the game of FIG. 12.

FIG. 16 illustrates the user positioning the switches to supply the correct responses to the questions presented by the question card.

FIG. 17 illustrates the bolt being removed from the latch by the solenoid and the hatch door automatically swinging open, wherein access to the paper prize is provided.

FIG. 18 illustrates the paper prize being loaded into the container through the open door.

FIG. 19 illustrates the door, with the paper prize therein, being closed.

FIG. 20 illustrates the question card, on one side of which are a series of questions and on the other side of which are a series of electrical connections associated with the questions, being changed for changing the preselected switch positions, so that the game is readied for the next use thereof.

DESCRIPTION OF PREFERRED EMBODIMENTS

Figure 1:
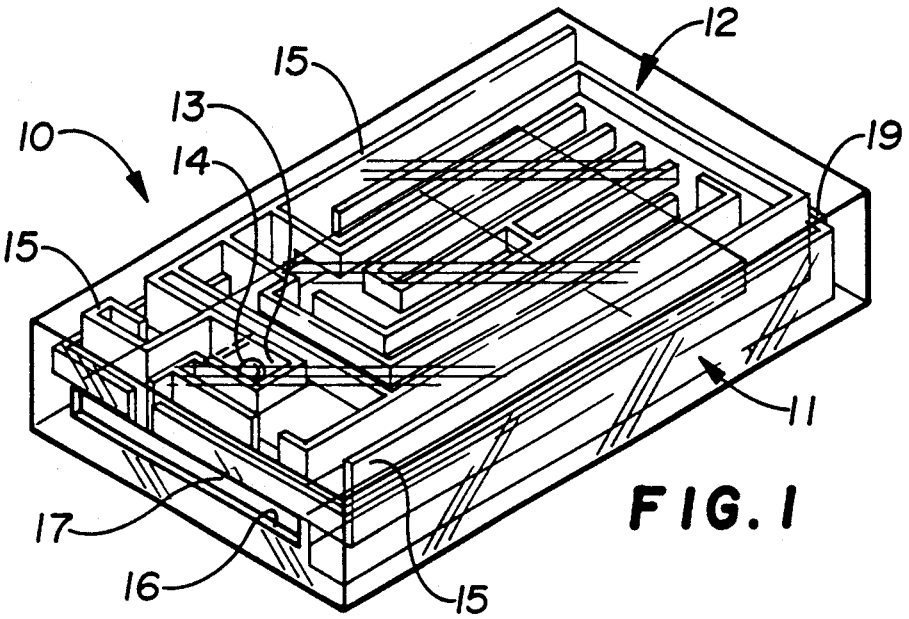
FIG. 1 is a perspective view of a first embodiment of the game of the present invention.
Figure 2:
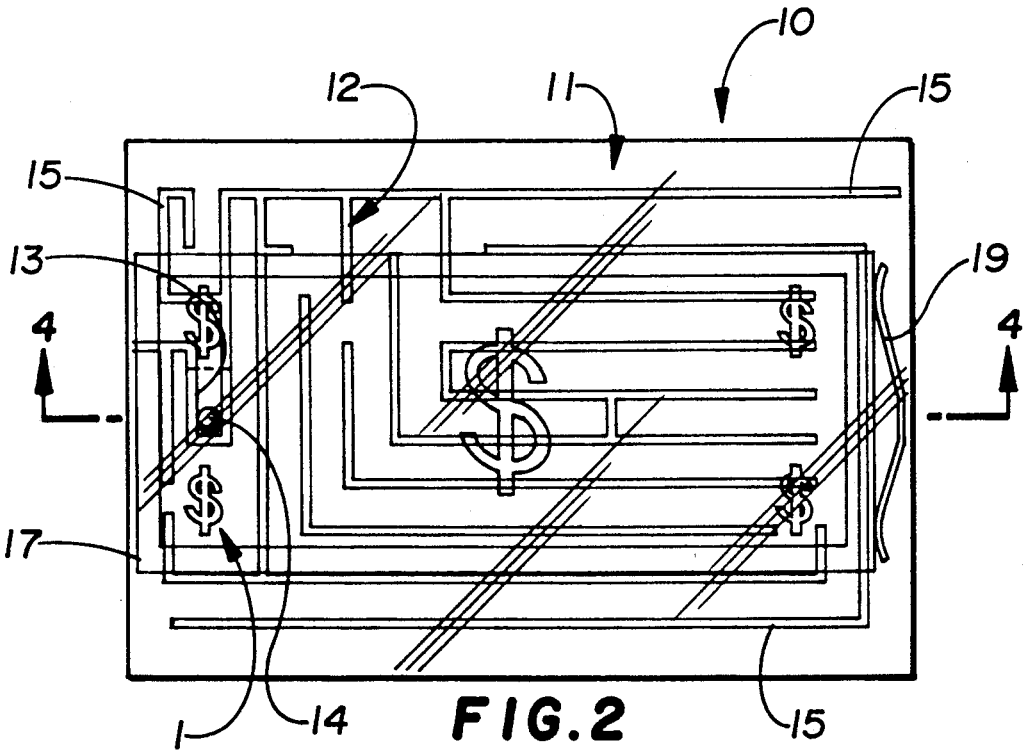
FIG. 2 is a top view of the game of FIG. 1.
Figure 3:
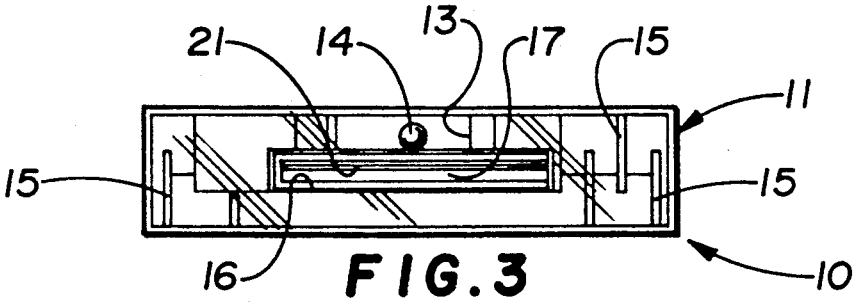
FIG. 3 is a end view of the game of FIG. 1.
Figure 4:
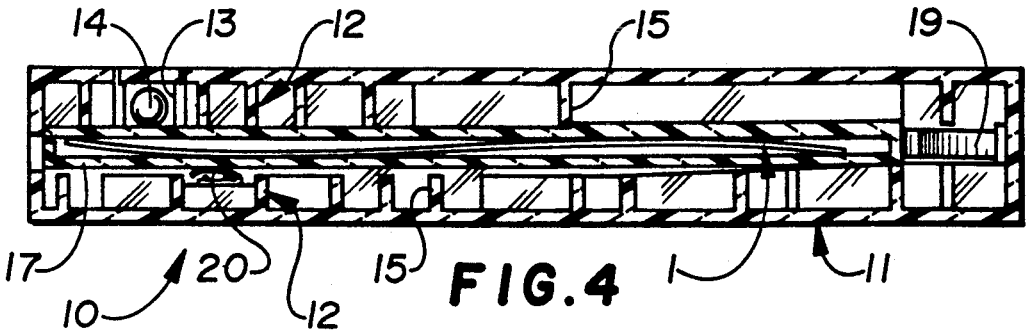
FIG. 4 is a front, cross-section view of the game taken along lines 4—4 of FIG. 2.
Figure 5:
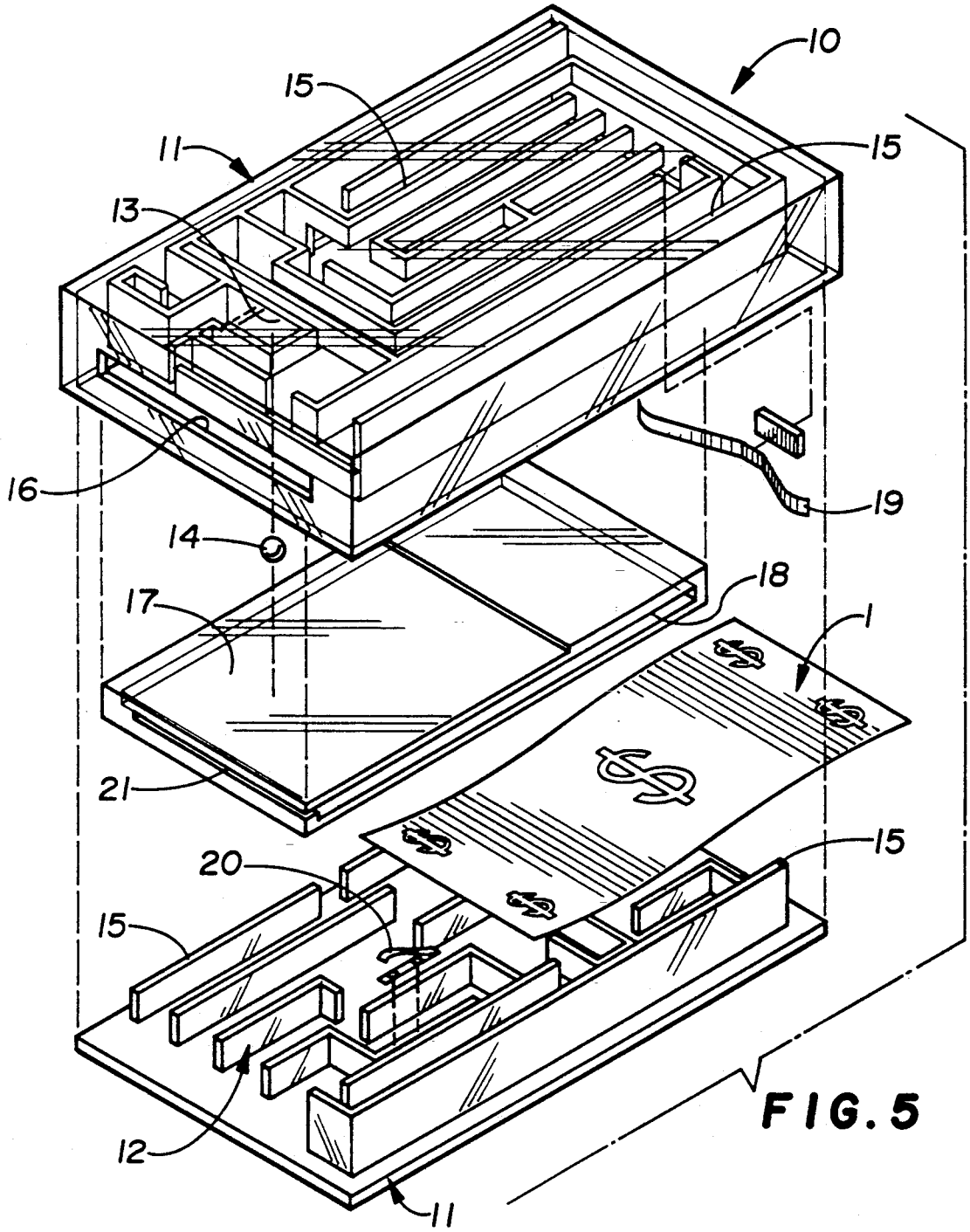
FIG. 5 is an exploded view of the game of FIG. 1.

Referring now to the drawings, the device of the present invention is a transparent, prize-presenting game 10 that has a puzzle (FIGS. 1–11) or a challenge (FIGS. 12–20) which are to be solved or completed in order for the paper prize 1, such as paper money, stock certificates or the like, to be presented thereby. Such a game 10 is provided for motivating a player to successfully solve and complete the puzzle or challenge.

The game 10 of the present invention includes a transparent container 11. Preferably, this transparent container 11 is a molded plastic container. The container 11 is substantially hollow so as to receive therein the challenge or game, as well as the paper prize 1, as shall be discussed at length below.

The paper prize 1, as shall be discussed at length below, is removably disposed in the container 11, so that access to the paper prize 1 is prevented without completing the puzzle or challenge. To receive access to the prize 1, the puzzle or challenge disposed in the container must be successfully solved and completed. In this manner, motivation is provided to a user thereof to successfully complete the puzzle or challenge by, for example, guiding the ball 14 through the maze 12 until the ball 14 is placed in the goal 13 (FIGS. 1–11) or by providing the correct responses to questions 22 that are presented thereby (FIGS. 12–20).

Finally, means is provided for providing access to the paper prize 1 only upon the successful completion of the puzzle or challenge. In this fashion, the user thereof is provided with the motivation of the paper prize 1 to successfully complete the puzzle or the challenge provided by the game.

It is noted here that the game 10 of the present invention, by being capable of presenting a paper prize 1 of paper money, stock certificates and the like, provides the targeted user thereof with considerable more motivation to attempt and successfully complete the puzzle or challenge presented thereby than do those banks/-games that are capable of only presenting a mere coin as a reward for the completion thereof.

Referring now to FIGS. 1–11, the device 10 of the present invention in the form of a puzzle is now discussed.

The puzzle of the game 10 of FIGS. 1–10 is in the form of a maze 12 having a goal 13 and a ball 14. To successfully complete the puzzle and receive access to the paper prize 1, the ball 14 must be guided through the maze 12 and placed in the goal 13. This may be achieved by, for example, the user thereof manually tilting and moving the game 10, as needed, to guide the ball 14 into the goal 13.

The maze 12 and the goal 13 may be formed in any sufficient fashion. However, it is contemplated herein that this be achieved by the formation of plastic ridges 15 on the interior of the container 11. In the game illustrated herein, the maze 12 extends both above and below the drawer 17 that is disposed therein and, as such, forms a bottom wall for that portion of the maze 12 located above the drawer 17 and a top wall for that portion of the maze 12 located below the drawer 17. In this manner, the maze 12 is located both above and below the drawer 17, thereby increasing the difficulty of successfully completing the puzzle.

The ball 14 may be fabricated from any suitable material, such as plastic or stainless steel (such as a stainless steel ball-bearing).

Staying with FIGS. 1–11, a first embodiment of a means for selectively providing a user access to the prize 1 is now discussed.

In the first embodiment, a slit 16 is formed in one of the end walls of the container 11. A slidable drawer 17 is disposed in the container 11. The drawer 17 itself also has a slit 18 formed therein for receiving the paper prize 1 therein.

The drawer 17 is disposed for radial sliding movement though the slit 16 between a first open position and a second closed position. In the first open position, the drawer 17 extends at least partially outwardly from the container 11, whereby the drawer 17 may be removed and the paper prize 1 made accessible to the user. In the second closed position, the drawer 17 is disposed within the container 11, whereby the paper prize is inaccessible to the user.

The means for providing access to the paper prize further includes a first resilient biasing means 19 and a second resilient biasing means 20.

The first resilient biasing means 19 is provided for constantly resiliently biasing (urging) the drawer 17 outwardly through the slit 16 and into the first open position thereof. Preferably, this first resilient biasing means 19 is a common leaf spring.

The second resilient biasing means 20 is provided for constantly resiliently biasing (urging) the drawer 17 (that is disposed in the second closed position thereof within the container 11) upwardly and out of alignment with the slit 16 (it is to be noted that, if desired, the positioning of the means 20 may be inverted so as to be above the drawer 17, so that the means 20 constantly resiliently biases the drawer 17 downwardly and out of alignment with the slit 16). Preferably, this second resilient biasing means 20 is also a common leaf spring.

With the drawer 17 in the second, closed position, when the puzzle or challenge is successfully completed, the user may overcome the second biasing means 20 and move the drawer 17 into alignment with the slit 16. This may be achieved by the user pushing downwardly (or, if the means 20 is located above the drawer 17, the user pushes upwardly) on that portion of the container 11 over which the ball 14 is located to selectively overcome the second biasing means 20 and move the drawer 17 in the other downward direction, so that the drawer 17 is pushed (urged) into alignment with the slit 16. In that position, the drawer 17 is then pushed outwardly through the slit 16 by the first resilient biasing means 19 and into the open position thereof.

Referring in particular now to FIGS. 6–9, the use of the puzzle 10 is now discussed.

Figure 6:
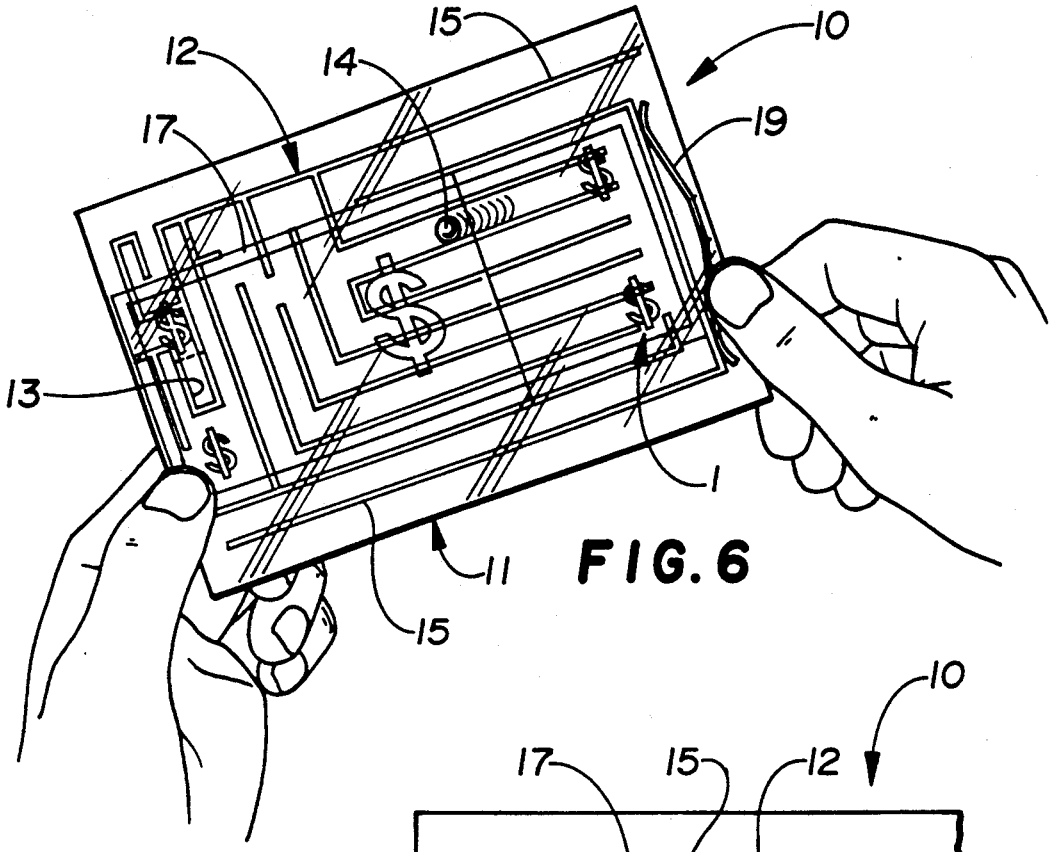
FIGS. 6–9 illustrate the use of the game of FIG. 1.
Figure 7:
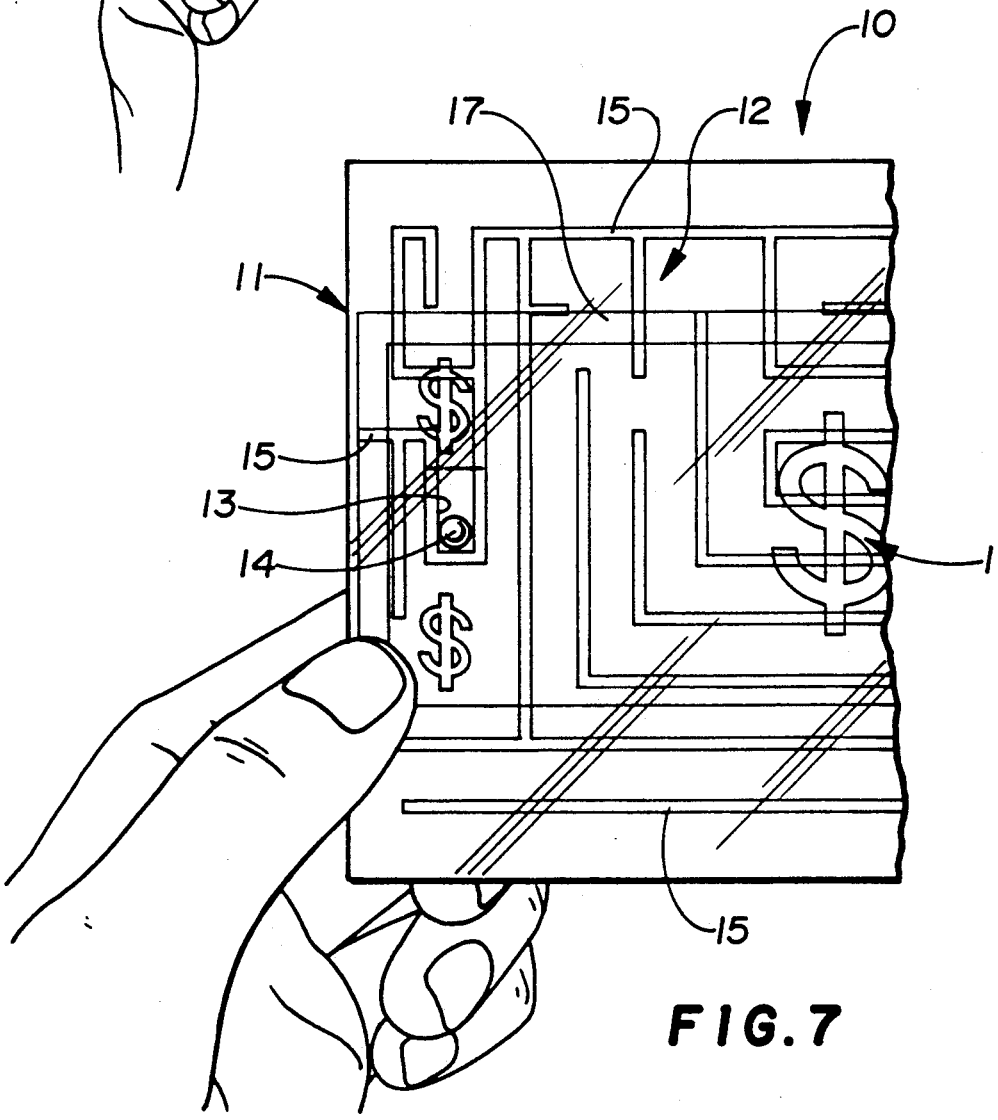
Figure 8:
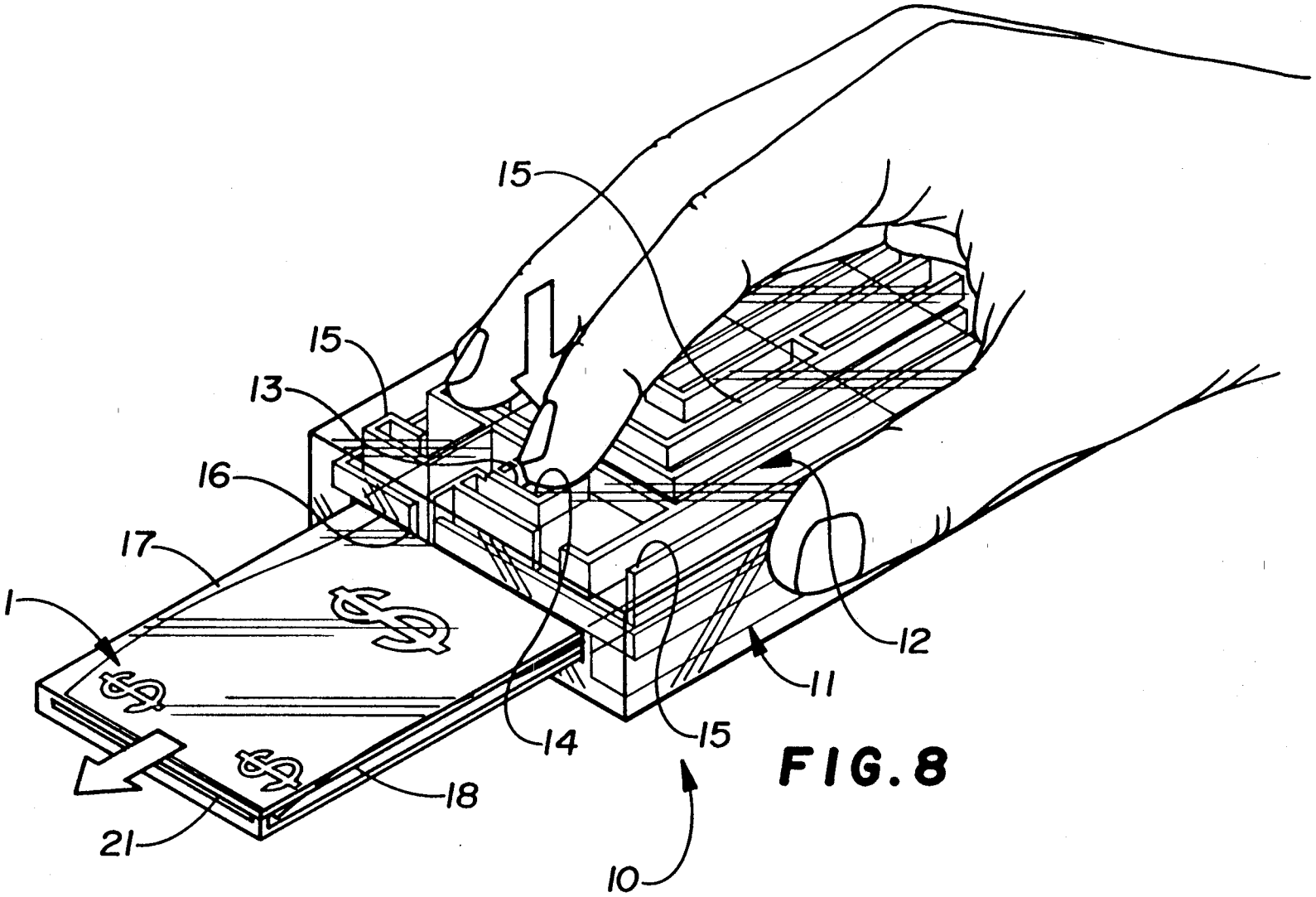
Figure 9:
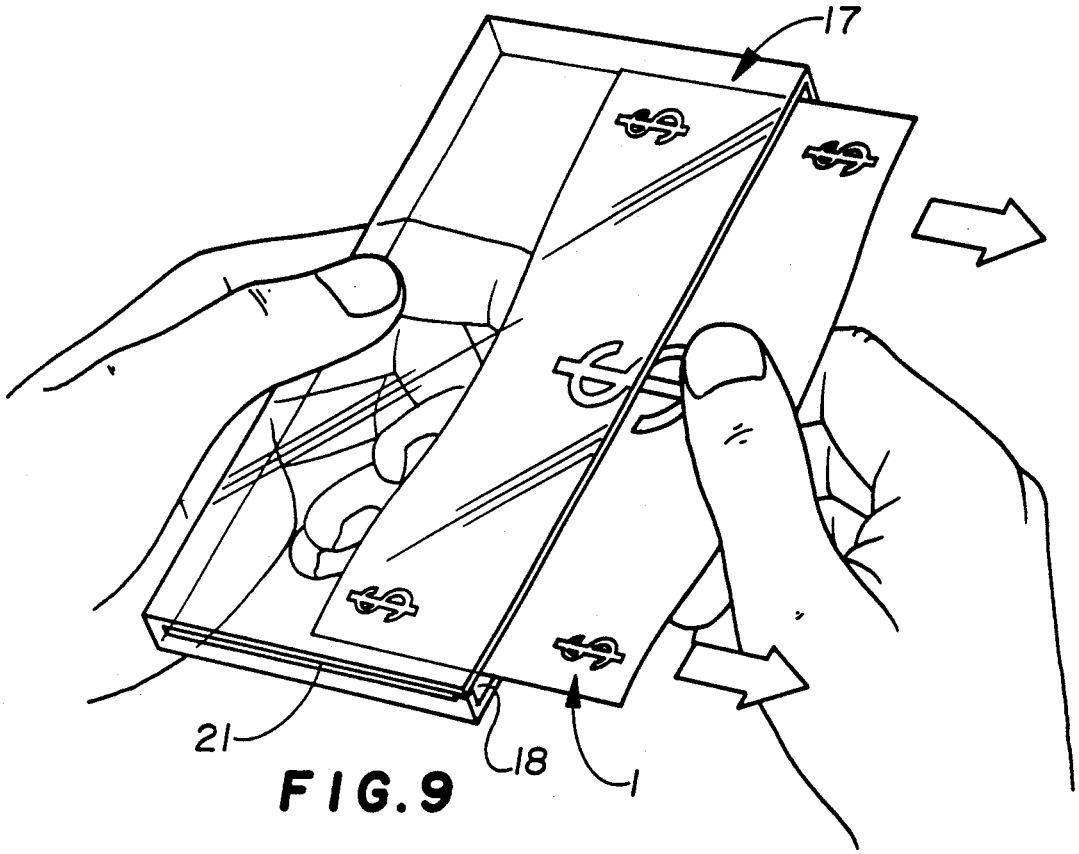

A user may guide the ball 14 through the maze 12 and into the goal 13 by manually moving and tilting the container 11, as needed (FIGS. 6 and 7). With the ball 14 in the goal 13 (FIG. 7), the user then may manually apply pressure on the top of the container 11 to push the ball 14 downwardly (FIG. 8). Such downward pressure on the ball 14 applies downward pressure on the drawer 17, one end of which is disposed below the goal 13. This downward pressure moves the drawer 17 downwardly and into alignment with the slit 16. With the drawer 17 now aligned with the slit 16, the first resilient biasing means 19 pushes (urges) the drawer 17 outwardly and into the first open position thereof, wherein the drawer 17 is extended at least partially outwardly from the container 11 (FIG. 8). In this position, the drawer 17 may be removed from the container 11. In this fashion, the user who has successfully completed the puzzle 10 is provided access to the paper prize 1 which is disposed in the drawer 17 and may remove the paper prize 1 from the drawer 17 via the slit 18 (FIG. 9).

Figure 10:
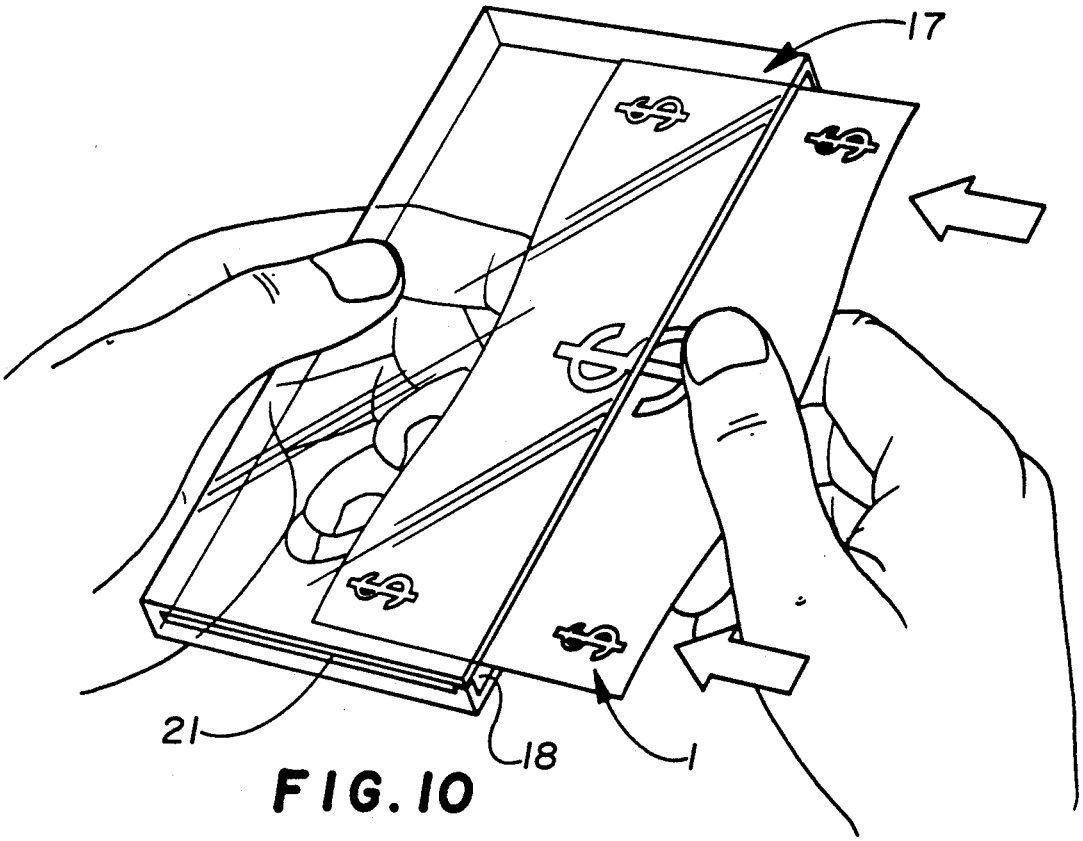
FIGS. 10 and 11 illustrate the loading of the paper prize, such as paper money, stock certificates and the like into the drawer of the game of FIG. 1.
Figure 11:
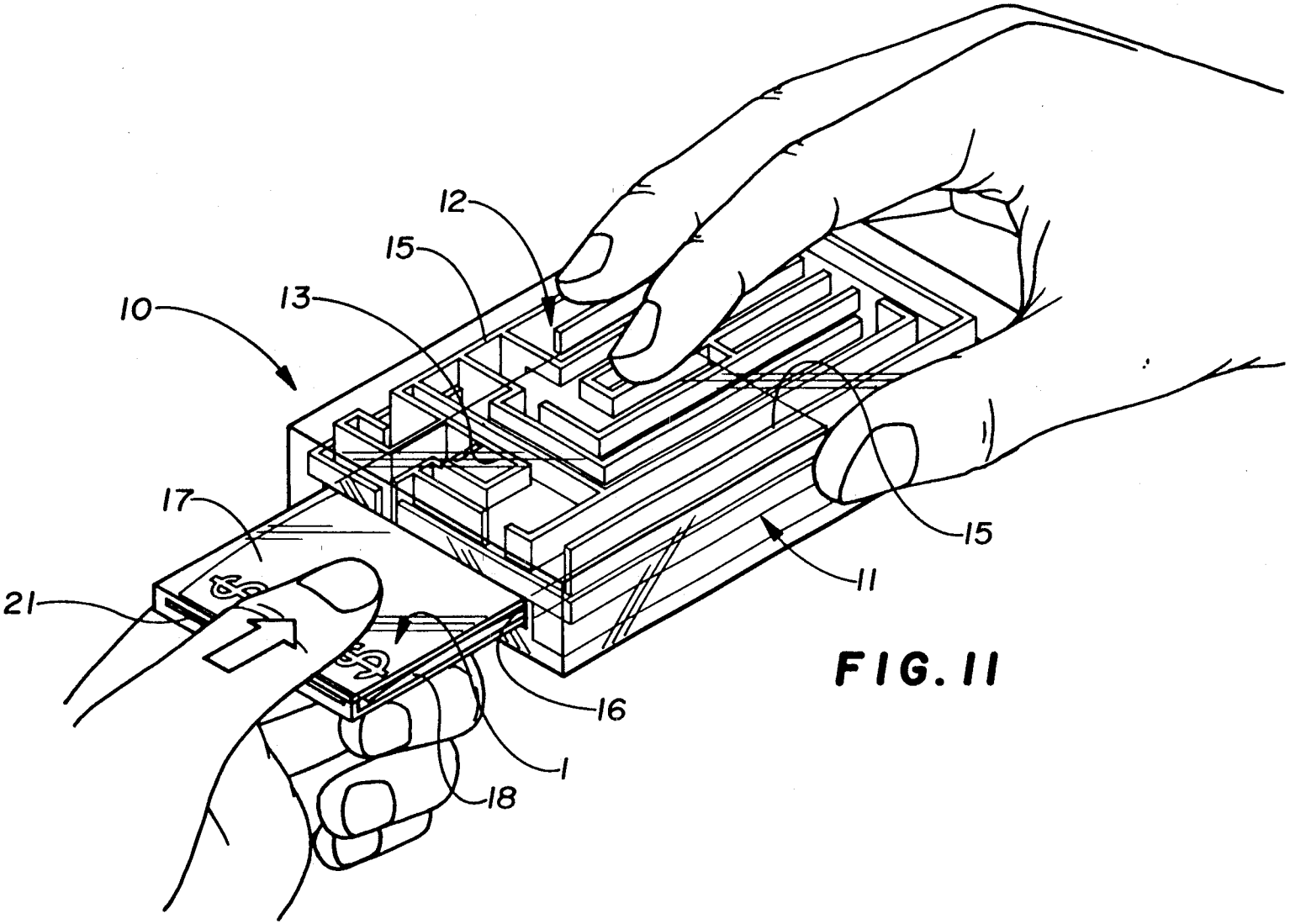
Figure 12:
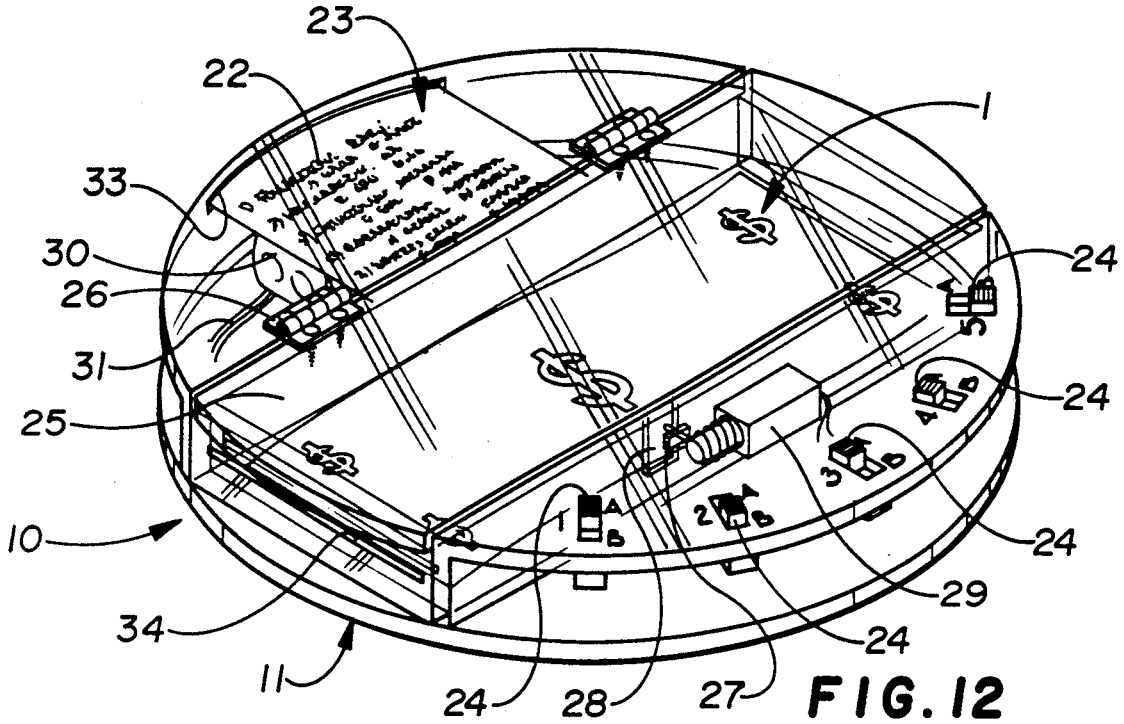
FIG. 12 is a perspective view of a second embodiment of the game of the present invention.
Figure 13:
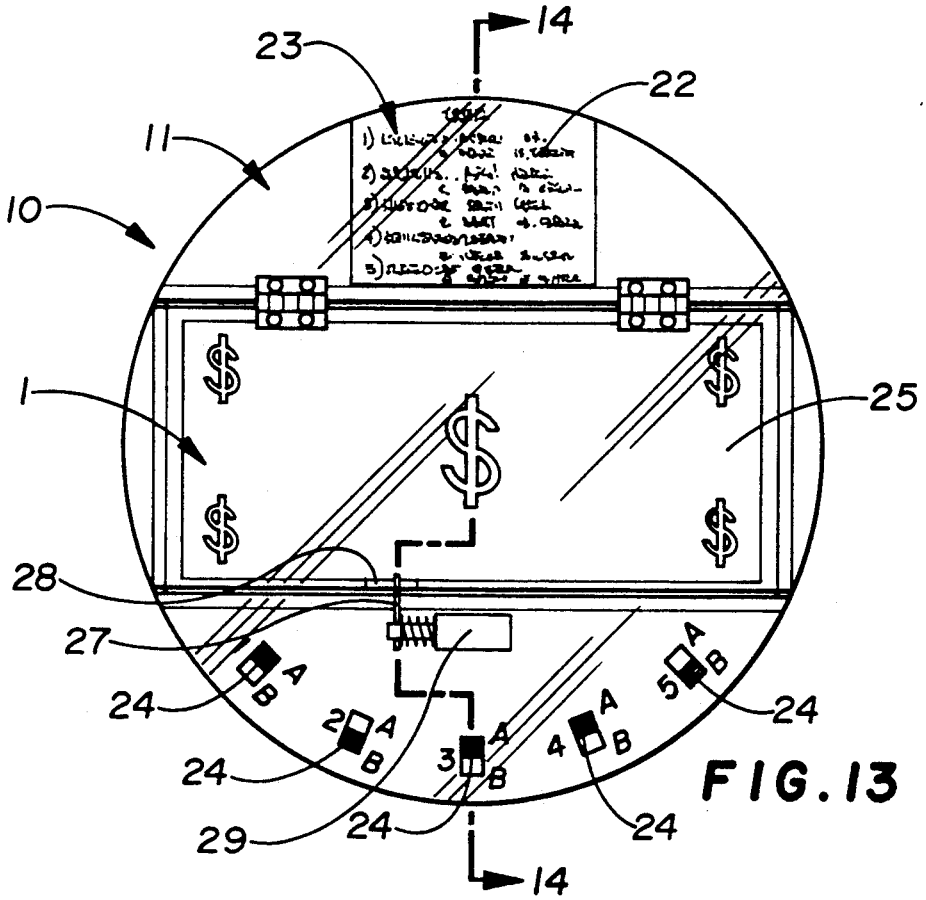
FIG. 13 is a top view of the game of FIG. 12.
Figure 14:
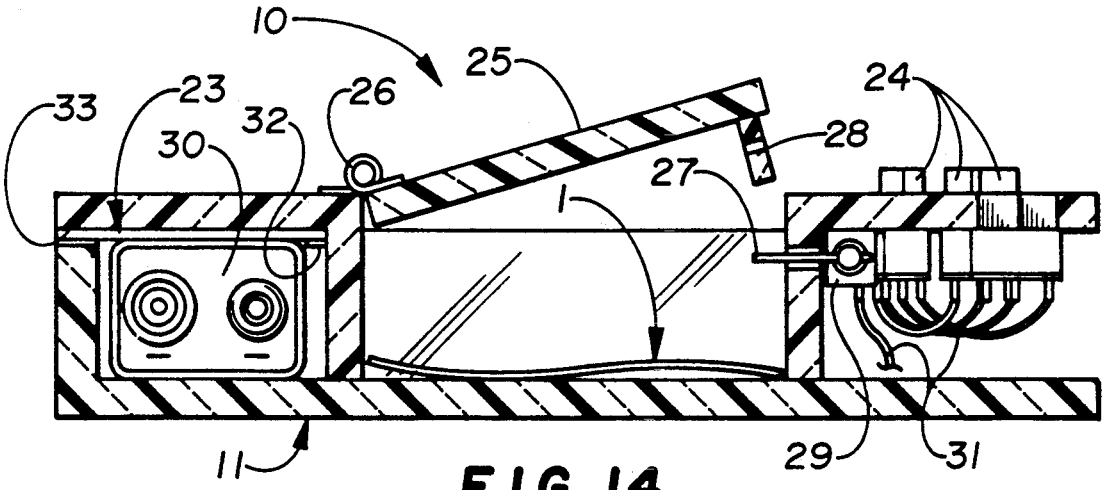
FIG. 14 is a cross-section view of the game taken along lines 14—14 of FIG. 13.

Referring in particular now to FIGS. 10 and 11, the loading of the paper prize 1 into the drawer 17 and the loading of the drawer 17 into the container 11 is now discussed.

As seen in FIG. 10, with the drawer 17 removed from the container 11, the paper prize 1 may be disposed in the drawer 17 via the slit 18. It is noted that, if desired, if the drawer 17 is already disposed in the container 11 (for example, when in the first open position thereof), one may dispose or load a paper prize 1 into the drawer 17 through a slit 21 that is formed in one end of the drawer 17. This would occur when, for example, the game 10 is first purchased with the drawer 17 already loaded or when one has loaded the drawer 17 without a paper prize 1 therein. In this regard, it is noted that while the paper prize 1 may be disposed into the drawer 17 through this slit 21, it may not be removed from the drawer 17 through the same slit 21.

With the paper prize 1 so loaded in the drawer 17, one may then manually push the drawer 17 inwardly overcoming the first resilient biasing means 19 until the drawer 17 is completely disposed in the second closed position thereof, wherein the drawer 17 is completely within the container 11 (FIG. 11). Positioned thusly, the second resilient biasing means 20 then biases (or urges) the drawer 17 upwardly and out of alignment with the slit 16, so that the action of the first resilient biasing means 19 pushes (urges) the drawer 17 against a sidewall of the container 11. In this position, the drawer 17 is reloaded into the container 11 and the game 10 is ready for the next use.

Referring now to FIGS. 12–20, the device 10 of the present invention in the form of a challenge is now discussed.

The challenge of FIGS. 12–20 is in the form of a series of questions 22 which are printed on a question or quiz card 23 and which have responses that are in the form of either true/false or yes/no or multiple choice responses which a user thereof is required to give. In the preferred embodiment, seen in the drawings, each card 23 has five (numbered or otherwise designated) cfuestions 22 printed thereon. To successfully complete the challenge and receive access to the paper prize 1, a user must select the correct responses to the questions 22. This may be achieved by, for example, by the user thereof manually placing respective (numbered or otherwise designated) response switches 24, which are carried by (disposed on) the container 11, into an appropriate designated position which represents the correct response to the questions 22. In the preferred embodiment, seen in the drawings, five (5) such switches—one for each question 22 on the card 23—are provided. Preferably, the switches 24 are toggle switches or any other bi or multi position switches. Especially preferred are those switches 24 commonly referred to as "Double-Pole, Double-Throw" ("DPDT") switches. It is contemplated herein that such switches 24 will have at least three different positions, two positions for providing a response to the questions 22 and the third position being a neutral position. For example, in the case of where the questions 22 are multiple choice questions one position will be provided for choice "A", one position for choice "B" and a third for a neutral position. In the case of where the questions 2 require a true/false response, one position is provided for the "TRUE" choice, one position is provided for the "FALSE" choice and the third position is a neutral position.

Staying with FIGS. 12–20, a second embodiment of a means for selectively providing a user access to the paper prize 1 is now discussed. In this embodiment, a door 25 is formed in the container 11. The door 25 is movable (pivotable) between a first open position and a second closed position. In the first open position, the door 25 is pivoted open, so as to permit access to a portion of the interior of the container 11 wherein a compartment is provided in which the paper prize 1 may be disposed. In this manner, the paper prize 1 may be disposed in and removed from the container 11 via the door 25. In the second closed position, the door 25 is pivoted closed, so as to prevent access to the portion of the interior of the container 11 where the paper prize 1 is disposed.

Preferably, the door 25 is in the form of a hinged hatch. It is further preferred that the game 10 include a third resilient biasing means 26 for constantly resiliently biasing the door 25 outwardly into the first open position thereof (see FIG. 14). In this regard, when (as shall be discussed at length below) the bolt 27 is in the first open position thereof (wherein the bolt 27 is removed from the latch 28) to unlock the door 25 so that the door 25 is open, the means 26 automatically swings the door 25 open. Preferably, this means 26 is a common coil spring.

The means for providing access to the paper prize 1 further includes a latch 28 and a bolt 27 arrangement that is formed between the door 25 and the container 11, so as to selectively unlock the door 25 to permit the door 25 to be opened for providing (permitting) access to the paper prize 1 and to selectively lock the door 25 to prevent (denying) access to the paper prize 1. In this regard, the bolt 27 is movable between a first open position and a second closed position. In the first open position, the bolt 27 is removed from the latch 28 to selectively unlock the door 25 so that the door 25 is open, thereby permitting access to the paper prize 1. In the second closed position, the bolt 27 is disposed in the latch 28, so as to selectively lock the door 25 shut for denying access to the paper prize 1.

Means is provided for selectively moving the bolt 27 between the first open and second closed positions thereof. This means is associated with the successful completion of the challenge so as to be activated when the challenge has been successfully completed. As seen in the drawings, this means includes a solenoid 29 that is associated with the bolt 27. An electrical power source 30, such as a battery 30 that is also disposed in the container 11 as is seen in the drawings, is provided for energizing the solenoid 29. The means further includes the series of switches 24 that are carried on the container 11, as was discussed at length above.

Means 31 is also provided for electrically connecting the power source 30, the switches 24 and the solenoid 29. In this fashion, with the switches 24 in the correct preselected position, electrical power from the power source 30 may flow to the solenoid 29. In this manner, the solenoid 29 is energized and activated for moving the bolt 27 into the first open position thereof, thereby unlocking the door 25 and providing the user with access to the paper prize 1. Further in this fashion, with the switches 24 in other than the correct preselected positions thereof, electrical power from the power source 30 is cut and may not flow to the solenoid 29. In this manner, the solenoid 29 is deactivated for moving (or maintaining) the bolt 27 into the second closed position, thereby locking the door 25 and denying access to the paper prize 1. Preferably these means 31 includes electrical wires 31 that are disposed in the container 11 extending between and in electrical communication with the electrical power source 30, the solenoid 29 and the switches 24.

If desired, the means for moving the bolt 27 may also include means for selectively changing the correct preselected positions of the switches 24. This means includes the card 23 being removably disposed in the container 11, so as to be interposed in the means 31 for electrically connecting the electrical power source 30 to the solenoid 29. The (obverse side) side of the card 23 that is opposite to the side having the questions 22 thereon is provided having electrical connections or contacts 32 thereon. These contacts 32 conform to the correct responses to the questions 22 on the other side of the card 23. In this respect, each card 23 carries a specific, varying, series of electrical connections 32 thereon, such that the positioning of the switches 24 must conform to the connections 32 for the hatch 25 (and, hence, the correct responses to the questions 22) to open.

It is contemplated herein that the challenge 11 will be provided with a plurality of such cards 23 each of which will bear different questions 22 on the one side thereof and corresponding connections 32 on the opposite side thereof. In this fashion, the cards 23 may be selectively inserted into and removed from the container 11 (for example, through a slot 33 that is formed in the container 11 for this purpose), such that a different series of questions will be confronted. Such a feature permits the game to be readily utilized as a learning tool which may be utilized in classroom and other suitable situations.

Figure 15:
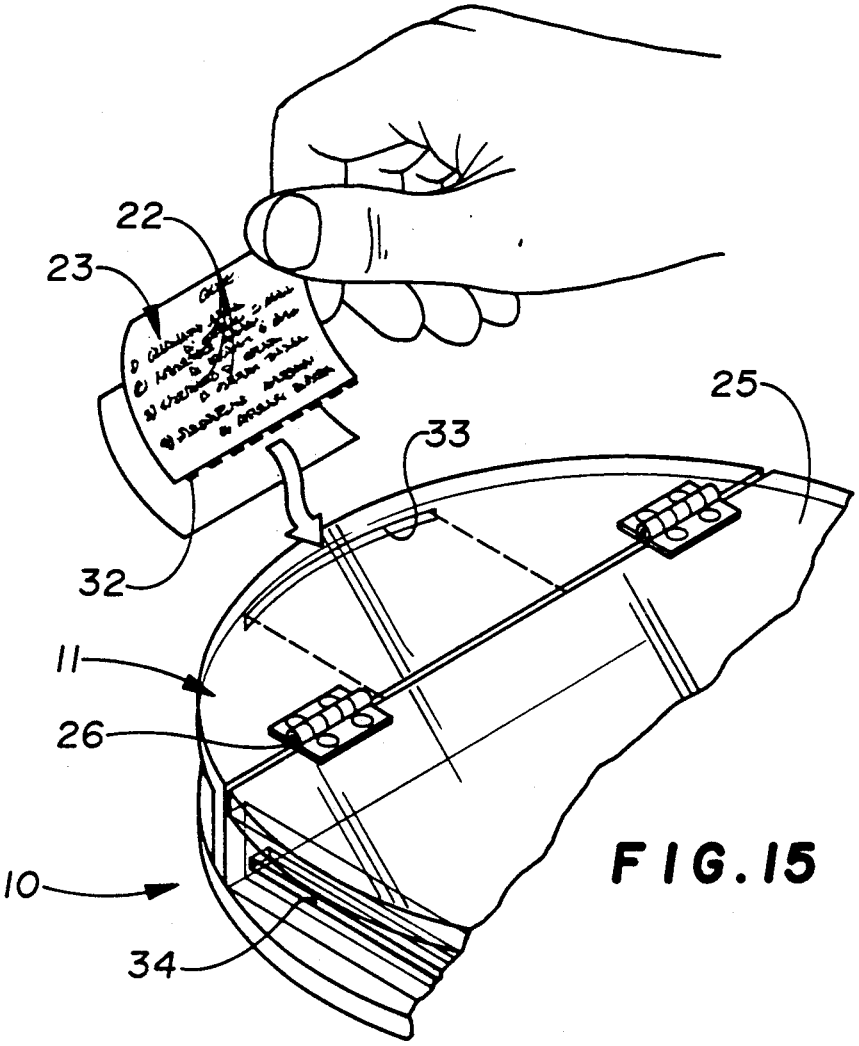
FIGS. 15–17 illustrate the use of the game of FIG. 11.
Figure 16:
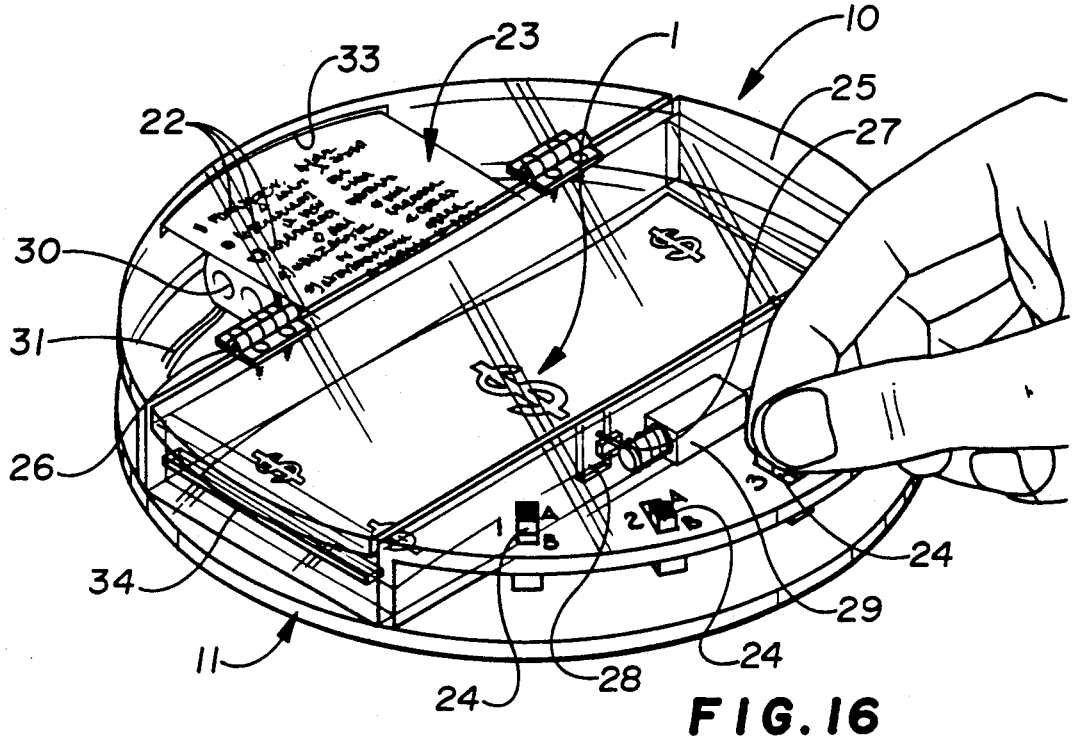
Figure 17:
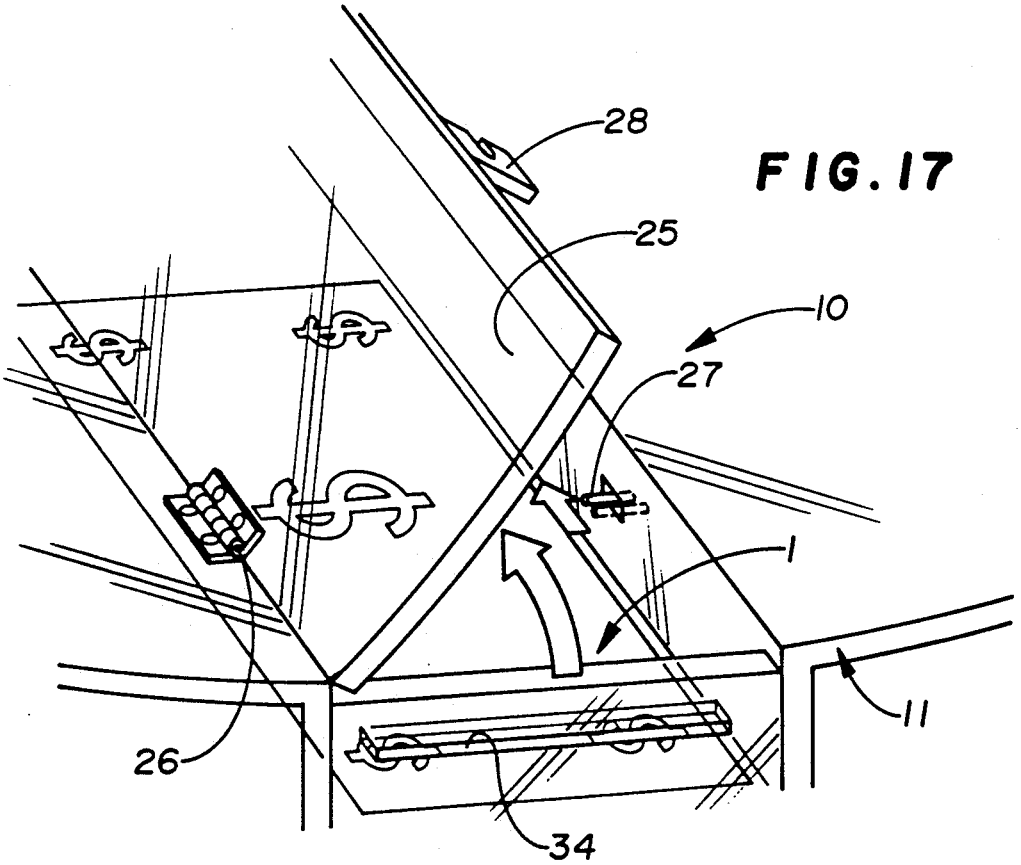

Referring in particular now to FIGS. 15–17, the use of the challenge discussed above is now discussed.

A user first loads a card 23 having a specific question 22 or series of questions 22 (as well as contacts 32) thereon into the appropriate space therefor through the slot 33 formed in the container 11 (FIG. 15). The user then answers each of the questions 22 on the card 23 with which they are presented by moving the switches 24 into the appropriate positions therefor, which positions represent the appropriate response to each individual question 22 (FIG. 16). In this regard, it is noted that each of the questions 22 is numbered and each of the switches 24 is indicated with a corresponding indicia numeral which is on the container 11. In this manner, the user will readily know which switch 24 corresponds to which question 22. Further, each switch position bears a specific indicia, such as "A", "B", "TRUE", "FALSE", etc., so that the user will readily know in which position to place the switches 24 in order to supply the answer that they desire to supply. With the switches 24 in the correct positions therefor, the connection is made between the electrical power source 30 and the solenoid 29, thereby closing the circuit and activating the solenoid 29. The activated solenoid 29 then moves the bolt 27 so as to remove the bolt 27 from the latch 28. Once the bolt 27 is removed from the latch 28 and the door 25 opened, the door 25 automatically swings open under the urging of the spring (FIG. 17). In this position, the user who has successfully completed the challenge by correctly answering all of the questions 22 is provided access to the paper prize I which is disposed in the container 11.

Figure 18:
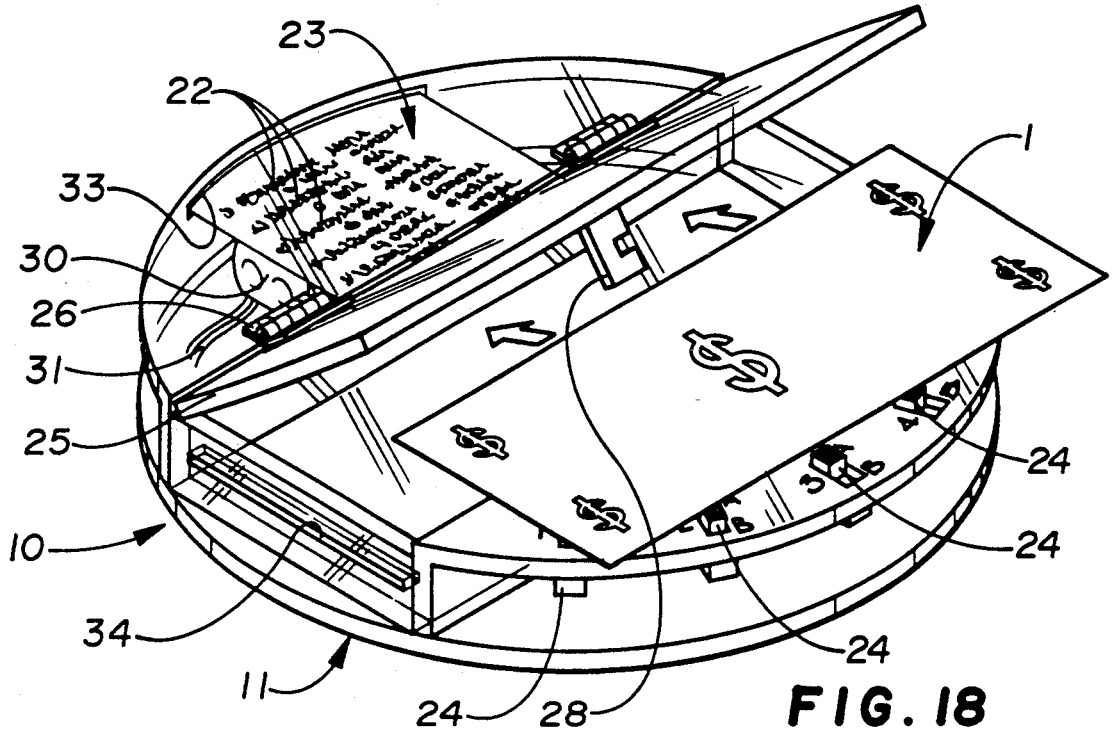
FIGS. 18–20 illustrate the loading of the paper prize into the container and preparation of the game of FIG. 12 for further use.
Figure 19:
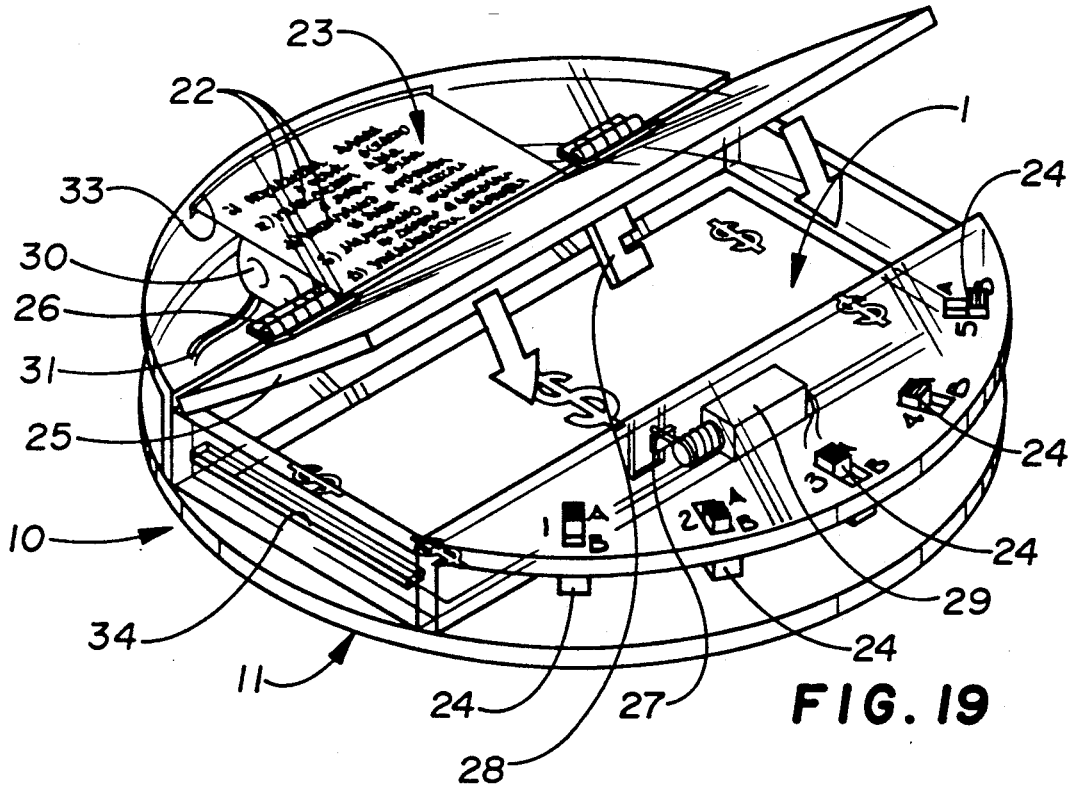
Figure 20:
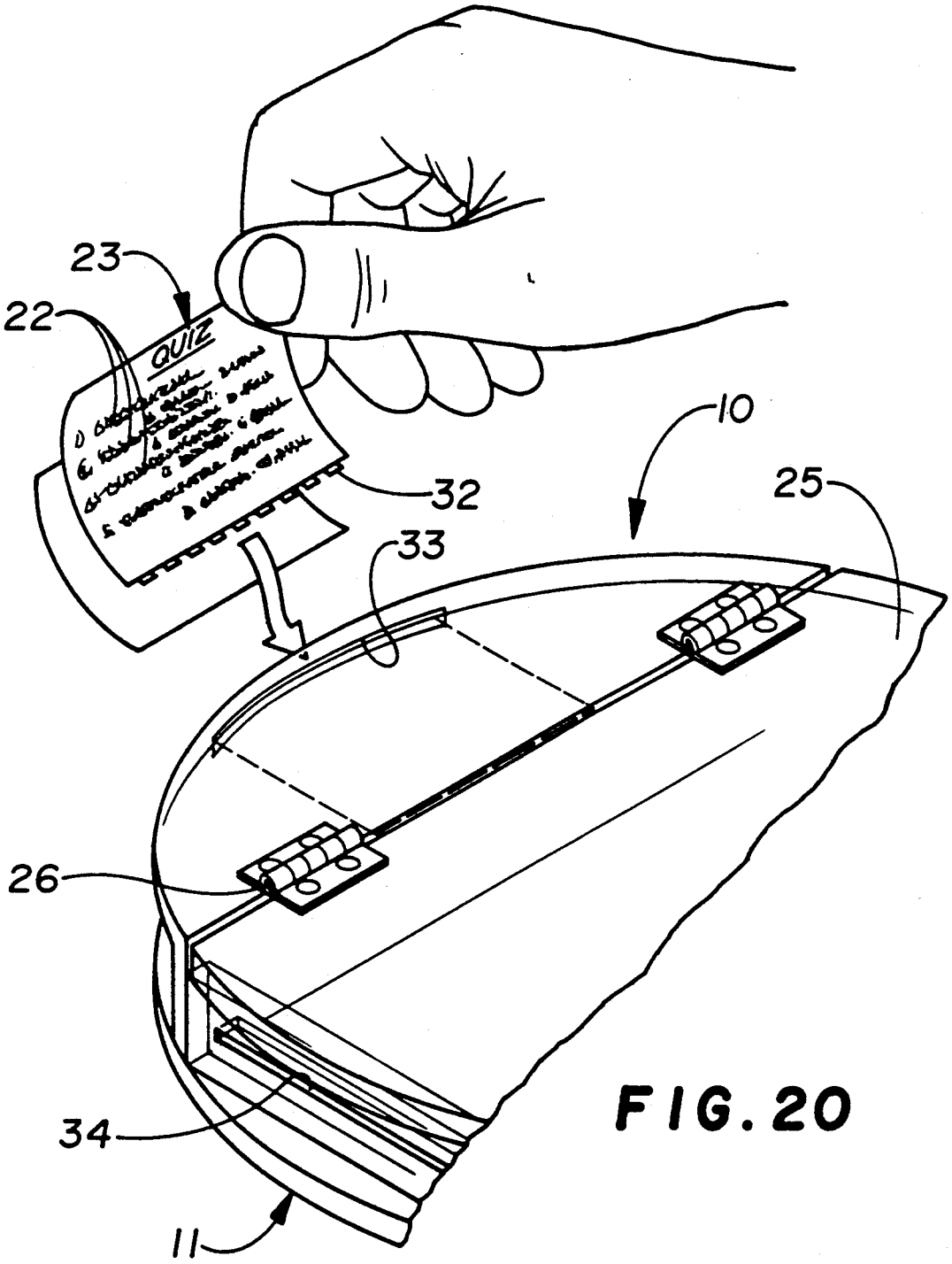

Referring in particular now to FIGS. 18–20, the loading of the paper prize into the container 11 through the door 25 is now discussed.

With the door 25 in the first open position thereof, one may dispose or load the paper prize I into the container 11 through the door 25 (FIG. 18). With the paper prize I so loaded, one may then manually push (pivot) the door 25 (overcoming the third resilient biasing means) until the door 25 is completely disposed in the second closed position thereof (FIG. 19). In this position, the container 11 is reloaded.

It is noted that, if desired, with the door 25 already in the second closed position, one may dispose or load the paper prize 1 into the door 25 through a slit 34 that is formed in the container 11. This would occur when, for example, the game 10 is first purchased with the door 25 already closed or when one has closed the door 25 without a paper prize 1 therein. In this regard, it is noted that while the paper prize 1 may be disposed into the container 11 through this slit 34, it may not be removed from the container 11 through this same slit 34.

Finally, one may manually remove the card 23 that had been disposed in the container 11, replacing it with a different card 23 bearing different questions 22 on one side thereof and different corresponding electrical connections or contacts 32 on the other opposite side thereof (FIG. 20). Thus prepared, the challenge 11 is ready for the next use.

Obviously, many modifications may be made of the ga-me of the present invention without departing from the basic spirit of the present invention. Accordingly, it will be appreciated by those skilled in the art that within the scope of the appended claims, the invention may be practiced other than has been specifically described herein.

What is claimed is:

1. A transparent prize presenting game having a puzzle or challenge to be solved or completed, the game being capable of presentation of a paper prize, thereby motivating a player to solve and complete the puzzle or challenge, the game comprising a hand held manipulable, transparent container wherein the paper prize is viewable, the paper prize being removably disposed in the container, so that access thereto without successfully completing the puzzle or challenge is prevented, the puzzle or a challenge to be solved and completed being disposed in the container, and means for providing access to the paper prize only upon the successful completion of the puzzle or challenge wherein the player gains access to the container to retrieve the paper prize, whereby the user thereof is provided with the motivation of the paper prize to successfully complete the puzzle or the challenge provided by the game.

2. The game of claim 1, wherein the container is a transparent molded-plastic container.

3. The game of claim 1, wherein the container is substantially hollow, and further wherein the game has a puzzle, the puzzle being a maze having a goal, the maze and the goal being formed from plastic ridges located within the container, and a ball disposed in the maze, so as to require the user to manually lift and tilt the game to guide the ball through the maze to the goal to successfully complete the puzzle.

4. The game of claim 1, wherein the container is substantially hollow and further wherein the game has a challenge, the challenge being a series of questions having responses required to be given thereto by the user, the game including response switches carried by the container which switches must be properly positioned by the user to indicate the correct response to the questions in order to successfully complete the challenge.

5. The game of claim 1, wherein the means for providing access to the paper prize is comprised of the container being substantially hollow, a slit formed in the container, a slidable drawer disposed in the container for radial sliding movement of the drawer through the slit between a first open position, wherein the drawer extends at least partially outwardly from the container and a second closed position, wherein the drawer is disposed within the container, the drawer provided for receiving the paper prize therein, so that with the drawer in the first open position, the paper prize is accessible to the user, and further so that with the drawer in the second closed position, the paper prize is inaccessible to the user.

6. The game of claim 1, wherein the means for providing access to the paper prize is comprised of the container being substantially hollow, a door formed in the container, so as to permit access to a portion of the interior of the container, so that the paper prize may be disposed therein and removed therefrom, a latch and bolt formed between the door and the container, so as to selectively permit the door to be opened for selectively permitting access to the paper prize in the container, and further so as to selectively permit the door to be closed for selectively denying access to the paper prize in the container, the bolt being moveable between a first open position, wherein the bolt is removed from the latch to selectively unlock the door so that the door is open, thereby permitting access to the paper prize, and a second closed position, wherein the bolt is disposed in the latch, to selectively lock the door shut, thereby denying access to the paper prize, and means for moving the bolt between the first open and second closed positions thereof, said means being associated with the successful completion of the puzzle or challenge.

7. The game of claim 6, wherein the means for moving the bolt includes a solenoid associated with the bolt, so as to selectively move the bolt between the first open and second closed positions thereof, an electrical power source, and a series of switches carried on the container, each switch being movable between at least two positions and means for electrically connecting the electrical power source, the switches and the solenoid, whereby with the respective switches each in a correct preselected position thereof, the solenoid is energized by the electrical power source so as to be activated for selectively moving the bolt into the first open position thereof, thereby unlocking the door and permitting access to the paper prize, and further whereby with the switches not in the correct preselected position, the solenoid is deactivated for selectively moving the bolt into the second closed position thereof, thereby locking the door and denying access to the paper prize.

8. The game of claim 7, wherein the electrical power source is a battery disposed in the container.

9. The game of claim 7, wherein the means for moving the bolt further includes a card interposable in the means for electrically connecting the switches with the solenoid, the card having a series of questions thereon, and the card further having a series of electrical connections thereon, each of the electrical connections on the card being associated with respective questions on the card and with respective switches, such that with all of the switches in the correct preselected positions thereof representing correct responses to the questions associated therewith, the electrical power source is electrically connected to the solenoid through the electrical connections.

10. The game of claim 9, wherein the means for electrically connecting the electrical power source to the solenoid includes electrical wires extending between and in electrical communication with the solenoid, the electrical connections on the card, the switches and the electrical power source.

11. The game of claim 9, wherein a plurality of cards are provided, each card having a series of questions thereon and a series of electrical connections thereon, each of the electrical connections on the card being associated with respective questions on the card and with respective switches, such that with all of the switches in the correct preselected positions thereof representing correct responses to the questions associated therewith, the electrical power source is electrically connected to the solenoid through the electrical connections, and further wherein the cards may be selectively interposed in and removed from the means for electrically connecting the electrical power source with the solenoid, whereby a means for selectively changing the correct preselected position of the switches is defined.

12. The game of claim 6, wherein the door is a hinged hatch.

13. The game of claim 6, further comprising a third resilient biasing means for constantly resiliently biasing the door outwardly, such that with the bolt in the first open position thereof wherein the bolt is removed from the latch to unlock the door so that the door is open, the door is automatically biased opened for permitting access to the paper prize in the container.

14. A transparent prize presenting game having a puzzle or challenge to be solved or completed, the game being capable of presentation of a paper prize, thereby motivating a player to solve and complete the puzzle or challenge, the game comprising a transparent container, the paper prize being removably disposed in the container, so that access thereto without successfully completing the puzzle or challenge is prevented, the puzzle or a challenge to be solved and completed being disposed in the container and means for providing access to the paper prize only upon the successful completion of the puzzle or challenge, whereby the user thereof is provided with the motivation of the paper prize to successfully complete the puzzle or the challenge provided by the game, the container being substantially hollow, a slit formed in the container, a slidable drawer disposed in the container for radial sliding movement of the drawer through the slit between a first open position, wherein the drawer extends at least partially outwardly from the container and a second closed position, wherein the drawer is disposed within the container, the drawer provided for receiving the paper prize therein, so that with the drawer in the first open position the paper prize is accessible to the user, and further so that with the drawer in the second closed position the paper prize is inaccessible to the user, wherein the means for providing access to the paper prize is comprised of a first resilient biasing means for constantly resiliently biasing the drawer outwardly through the slit and into the first open position thereof when the drawer is aligned with the slit, and a second resilient biasing means for constantly resiliently biasing the drawer out of alignment with the slit, wherein the drawer may be pushed inwardly overcoming the first biasing means until the drawer is disposed in the second closed position thereof within the container, and further wherein with the drawer in the second closed position the drawer is biased out of alignment with the slit by the second biasing means for loading the drawer, and wherein, with the puzzle or challenge successfully completed, the user may over come the second biasing means and move the drawer into alignment with the slit.

15. The game of claim 14, wherein the first resilient biasing means is a spring.

16. The game of claim 14, wherein the second resilient biasing means is a spring.

17. The game of claim 16, wherein the spring is a leaf spring.

18. A transparent prize presenting game having a maze including a goal and a ball disposed in the maze, so that to successfully complete the maze, the ball must be guided through the maze and placed in the goal, the game being capable of presentation of a paper prize upon placement of the ball in the goal, thereby motivating a player to complete the maze by placing the ball in the goal, the game comprised of a transparent substantially hollow container, the maze and the goal thereof being formed from plastic ridges located within the container, a paper prize removably disposed in the container, so that access thereto without successfully completing the maze and placing the ball in the goal is prevented, and further so that access to the paper prize upon successful completion of the maze and placement of the ball in the goal is provided, and means for providing access to the paper prize only upon the successful completion of the maze and placement of the ball in the goal, whereby the user thereof is provided with the motivation of the paper prize to successfully complete the maze and place of the ball in the goal, wherein the means for providing access to the paper prize is comprised of a slit formed in the container, a slidable drawer for receiving the paper prize therein, the drawer disposed in the container for radial sliding movement of the drawer through the slit between a first open position, wherein the drawer extends at least partially outwardly from the container and the paper prize is accessible to the user and a second closed position, wherein the drawer is disposed within the container and the paper prize is inaccessible to the user, and a first resilient biasing means for constantly resiliently biasing the drawer outwardly through the slit and into the first open position thereof, second resilient biasing means for constantly resiliently biasing the drawer out of alignment with the slit, wherein the drawer may be pushed inwardly overcoming the first biasing means until the drawer is disposed in the second closed position thereof within the container, and further wherein the drawer in the second closed position, the drawer is biased out of alignment with the slit by the second biasing means for loading the drawer, and wherein the puzzle or challenge successfully completed, the user may overcome the second biasing means and move the drawer into alignment with the slit.

19. A transparent prize presenting game having a challenge comprised of a series of questions having responses required to be given thereto by the user to successfully complete the challenge, the game being capable of presentation of a paper prize upon supplying the correct responses to the questions and successful completion of the challenge, thereby motivating a player to successfully complete the challenge, the game comprising a transparent substantially hollow container, a paper prize, removably disposed in the container, so that access thereto without successfully supplying the correct responses to the questions and completing the challenge is prevented, and further so that access to the paper prize upon successfully supplying the correct responses to the questions is provided, and means for providing access to the paper prize only upon successfully supplying the correct responses to the questions, whereby the user thereof is provided with the motivation of the paper prize to successfully complete the challenge provided, wherein the means for providing access to the paper prize is comprised of a series of response switches carried by the container each of which switches must be properly positioned by the user to indicate the proper response to the questions, and said means further including a hinged hatch door formed in the container, so as to permit access to a portion of the interior of the container wherein the paper prize is disposed, so that the paper prize may be disposed therein and removed therefrom, a latch and bolt formed between the door and the container, so as to selectively permit the door to be opened for selectively providing access to the paper prize, the bolt moveable between a first open position, wherein the bolt is removed from the latch to selectively unlock the door so it is open, thereby permitting access to the paper prize, and a second closed position, wherein the bolt is disposed in the latch, to selectively lock the door shut, thereby denying access to the paper prize, and means for moving the bolt between the first open and second closed positions thereof, said means being associated with the successful supplying of correct responses to the questions and completion of the challenge.

20. The game of clam 19, wherein the means for moving the bolt between the first and second positions thereof includes a solenoid associated with the bolt, so as to selectively move the bolt between the first open and second closed positions thereof, an electrical power source, the series of switches being carried on the container, each switch being movable between at least two positions, electrical wires for electrically connecting the electrical power source, the switches and the solenoid, a plurality of cards, each card having a series of questions thereon and a series of electrical connections thereon, each of the electrical connections on the card being associated with respective questions on the card and with respective switches, such that with all of the switches in the correct preselected positions thereof representing correct responses to the questions associated therewith, the electrical power source is electrically connected to the solenoid through the electrical connections for energizing the solenoid by the electrical power source for selectively moving the bolt into the first open position thereof, thereby unlocking the door and permitting access to the paper prize, and further whereby with the switches not in the correct preselected position, the solenoid is deactivated for selectively moving the bolt into the second closed position thereof, thereby locking the door and denying access to the paper prize, and further wherein the cards may be selectively interposed in and removed from the means for electrically connecting the electrical power source with the solenoid, whereby a means for selectively changing the correct preselected position of the switches is defined.

* * * * *